US012233460B2

(12) United States Patent
Nakako et al.

(10) Patent No.: US 12,233,460 B2
(45) Date of Patent: Feb. 25, 2025

(54) COPPER PASTE, WICK FORMATION METHOD, AND HEAT PIPE

(71) Applicant: Resonac Corporation, Tokyo (JP)

(72) Inventors: Hideo Nakako, Tokyo (JP); Toshiaki Tanaka, Tokyo (JP); Dai Ishikawa, Tokyo (JP); Yoshinori Ejiri, Tokyo (JP); Michiko Natori, Tokyo (JP)

(73) Assignee: Resonac Corporation, Tokyo (JP)

( * ) Notice: Subject to any disclaimer, the term of this patent is extended or adjusted under 35 U.S.C. 154(b) by 0 days.

(21) Appl. No.: 18/026,244

(22) PCT Filed: Sep. 16, 2021

(86) PCT No.: PCT/JP2021/034090
§ 371 (c)(1),
(2) Date: Mar. 14, 2023

(87) PCT Pub. No.: WO2022/059733
PCT Pub. Date: Mar. 24, 2022

(65) Prior Publication Data

US 2023/0356294 A1 Nov. 9, 2023

(30) Foreign Application Priority Data

Sep. 17, 2020 (JP) ..... 2020-156581

(51) Int. Cl.

| | |
|---|---|
| ***B22F 3/10*** | (2006.01) |
| ***B22F 1/12*** | (2022.01) |
| ***F28D 15/04*** | (2006.01) |

(52) U.S. Cl.
CPC ..... *B22F 3/1035* (2013.01); *B22F 1/12* (2022.01); *F28D 15/046* (2013.01); *B22F 2301/10* (2013.01); *B22F 2304/10* (2013.01)

(58) Field of Classification Search
CPC ..... B22F 3/1035; B22F 1/12; B22F 2301/10; B22F 2304/10; B22F 2007/047; B22F 1/052; B22F 1/054; B22F 1/0545; B22F 1/065; B22F 1/068; B22F 3/1021; B22F 7/08; B22F 1/10; F28D 15/046; F28F 2255/18; F28F 21/085; C22C 1/0425
See application file for complete search history.

(56) References Cited

FOREIGN PATENT DOCUMENTS

| | | | | | |
|---|---|---|---|---|---|
| JP | 2003-222481 | A | | 8/2003 | |
| JP | 2004-332069 | A | | 11/2004 | |
| JP | 2006-124833 | A | | 5/2006 | |
| JP | 2018152403 | A | * | 9/2018 | ..... H01L 2224/322 |

* cited by examiner

*Primary Examiner* — Rick K Chang
(74) *Attorney, Agent, or Firm* — FITCH, EVEN, TABIN & FLANNERY, LLP

(57) ABSTRACT

Provided is a copper paste for forming a wick of a heat pipe, the copper paste containing copper particles, thermally decomposable resin particles, a dispersion medium for dispersing the copper particles and the thermally decomposable resin particles, and a thermally decomposable resin that is soluble in the dispersion medium.

20 Claims, 5 Drawing Sheets

(a)

(b)

(c)

(a)

(b)

(c)

(a)

(b)

COPPER PASTE, WICK FORMATION METHOD, AND HEAT PIPE

CROSS-REFERENCE TO RELATED APPLICATIONS

This application is a U.S. national phase application filed under 35 U.S.C. § 371 of International Application No. PCT/JP2021/034090, filed Sep. 16, 2021, designating the United States, which claims priority from Japanese application No. 2020-156581, filed Sep. 17, 2020, which are incorporated herein by reference in their entireties.

TECHNICAL FIELD

The present invention relates to a copper paste, a method for forming a wick, and a heat pipe.

BACKGROUND ART

A heat pipe is a passive heat transfer element that utilizes evaporation and condensation of a working liquid and includes, in a hermetically sealed space, a working liquid and a member called a "wick" that produces a capillary pumping action. Since heat pipes can transport a large amount of heat with a small temperature difference, heat pipes are attracting attention as heat dissipation devices for small-sized information devices such as smartphones. For example, Patent Literature 1 discloses a heat pipe including a wick composed of a porous sintered powder. In a case of composing a wick with a porous sintered powder, a method of depositing a sinterable metal powder (for example, copper powder) at a predetermined site, subsequently compressing the metal powder under pressure, and firing the metal powder to be sintered, is generally used.

CITATION LIST

Patent Literature

Patent Literature 1: Japanese Unexamined Patent Publication No. 2003-222481

SUMMARY OF INVENTION

Technical Problem

Regarding the heat pipes, pipe-shaped ones have been traditionally used in many cases; however, from the viewpoint of miniaturization, adhesion to heat sources, and the like, flat plate-shaped heat pipes called vapor chambers have come to be used. In such flat plate-shaped heat pipes, thickness reduction is underway due to the limitation of the volume of small-sized information devices, and it is required that the wick is also formed to have a small thickness. Furthermore, in the flat plate-shaped heat pipes, the surface on which the wick is formed may have a complicated shape such as a shape with protrusions and depressions. However, in a case of composing a wick with a porous sintered powder, it is difficult to deal with such wicks having a thin thickness and wicks having a complicated shape in conventional production methods. The inventors of the present invention are conducting an investigation on forming a wick using a paste composition containing copper particles (copper paste).

When a copper paste is used, wicks as thin films and wicks having a complicated shape can be conveniently formed by printing. On the other hand, there is still room for improvement in the porosity of the wick (proportion of pores in the wick).

Thus, one of objects of the present invention is to provide a copper paste capable of forming a wick having a high porosity.

Solution to Problem

The present inventors conducted a thorough investigation, and as a result, they found that the porosity of a wick can be improved by blending a particulate thermally decomposable resin (thermally decomposable resin particles) into a copper paste, thus completing the present invention.

That is, an aspect of the present invention relates to a copper paste for forming a wick as shown in the following [1] to [7], a method for forming a wick as shown in [8], and a heat pipe as shown in [9].

[1] A copper paste for forming a wick of a heat pipe, the copper paste containing copper particles, thermally decomposable resin particles, a dispersion medium for dispersing the copper particles and the thermally decomposable resin particles, and a thermally decomposable resin that is soluble in the dispersion medium.

[2] The copper paste according to [1], wherein a content of the thermally decomposable resin particles is 3 to 30 parts by mass with respect to 100 parts by mass of a total amount of the copper particles and the thermally decomposable resin particles.

[3] The copper paste according to [1] or [2], wherein the thermally decomposable resin particles have a volume average particle diameter of 5 to 40 μm.

[4] The copper paste according to any one of [1] to [3], wherein a 95% thermal decomposition temperature of the thermally decomposable resin particles and the thermally decomposable resin is 450° C. or lower.

[5] The copper paste according to any one of [1] to [4], wherein a content of the thermally decomposable resin is 1 to 25 parts by mass with respect to 100 parts by mass of the copper particles.

[6] The copper paste according to any one of [1] to [5], wherein a proportion of copper particles having a particle diameter of 1.5 μm or less is 10% by volume or more based on a total amount of the copper particles.

[7] The copper paste according to any one of [1] to [6], wherein the copper paste has a viscosity at 25° C. of 10 to 120 Pa·s.

According to the copper paste of the above-described aspect, a wick having a high porosity can be formed by printing.

Meanwhile, when a thin-film wick (for example, a wick having a thickness of 50 μm or less) is formed, it is preferable to use copper particles having a volume average particle diameter smaller than the film thickness of the wick, from the viewpoint of sinterability. However, when copper particles having a small volume average particle diameter are used, the pore size becomes smaller, and the porosity also becomes smaller, so that the flow resistance caused by capillary phenomenon tends to increase. Therefore, in conventional methods such as described above, it is difficult to form a thin-film wick having a sufficiently high porosity. On the other hand, according to the copper paste of the above-described aspect, since pores can be formed by the thermally decomposable resin particles, even when copper particles having a small volume average particle diameter (for example, having a volume average particle diameter of 50 μm or less) are used, a wick having a sufficiently large pore size can be formed. Therefore, the copper paste of the above-described aspect is suitable for forming a thin-film wick (for example, a wick having a thickness of 50 μm or less).

[8] A method for forming a wick of a heat pipe, the method including: a step of printing the copper paste according to any one of [1] to [7]; and a step of sintering the copper paste.

[9] A heat pipe including a wick including a sintered body of the copper paste according to any one of [1] to [7].

Advantageous Effects of Invention

According to the present invention, a copper paste that can form a wick having a high porosity can be provided.

DESCRIPTION OF EMBODIMENTS

Figure 1:
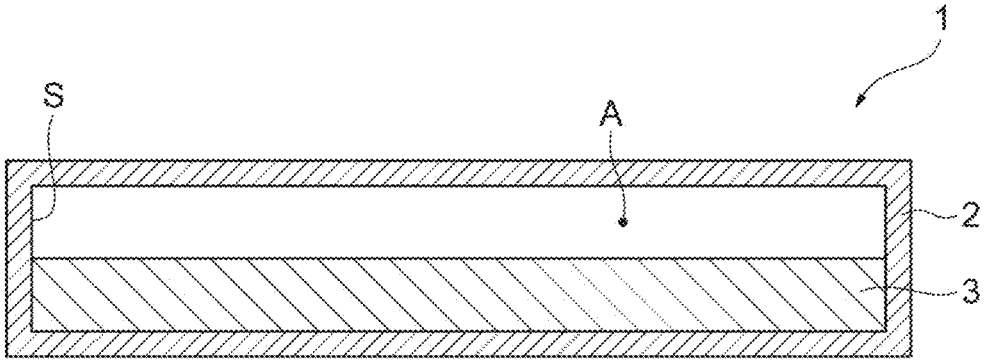
FIG. 1 is a schematic cross-sectional view showing a heat pipe according to an embodiment.

According to the present specification, a numerical value range expressed using the term "to" represents a range including the numerical values described before and after the term "to" as the minimum value and the maximum value, respectively. With regard to numerical value ranges described stepwise in the present specification, the upper limit value or the lower limit value described in one numerical value range may be replaced with the upper limit value or the lower limit value of another numerical value range described stepwise. Furthermore, unless particularly stated otherwise, the materials listed as examples in the present specification can be used singly or in combination of two or more kinds thereof. According to the present specification, when there is a plurality of substances corresponding to each component in the composition, unless particularly stated otherwise, the content of each component in the composition means the total amount of the plurality of substances present in the composition. Furthermore, in the present specification, the term "(meth)acryl" means at least one of acryl and methacryl corresponding thereto. Furthermore, the term "(crosslinked)" means both a case with the suffix "crosslinked" and a case without the suffix "crosslinked".

Hereinafter, suitable embodiments of the present invention will be described. However, the present invention is not intended to be limited to the following embodiments.

<Copper Paste>

A copper paste according to an embodiment is a copper paste for forming a wick, which is used for forming a wick of a heat pipe. The copper paste contains copper particles, thermally decomposable resin particles, a dispersion medium capable of dispersing the copper particles and the thermally decomposable resin, and a thermally decomposable resin that is soluble in the dispersion medium. In the following description, in some cases, the thermally decomposable resin that constitutes the thermally decomposable resin particles is referred to as "thermally decomposable resin A", and the thermally decomposable resin that is soluble in the dispersion medium is referred to as "thermally decomposable resin B". The components included in the copper paste will be each described below.

(Copper Particles)

The copper particles are particles containing metal copper as a main component and are dispersed in the dispersion medium in the copper paste. The content of copper element in the copper particles may be 90 atm % or more based on the total amount of the metal elements included in the copper particles. When the content of the copper element is 90 atm % or more, satisfactory sinterability and satisfactory thermal conductivity are likely to be obtained. From such a viewpoint, the content of the copper element may also be 93 atm % or more or 95 atm % or more, based on the total amount of the metal elements included in the copper particles. In other words, the content of the metal elements other than copper element in the copper particles may be 10 atm % or less, 7 atm % or less, or 5 atm % or less, based on the total amount of the metal elements included in the copper particles.

The copper particles may include copper oxide. The content of copper oxide in the copper particles may be 20% by mass or less, 15% by mass or less, or 10% by mass or less, based on the total mass of the copper particles. When the content of copper oxide is in the above-described range, volumetric contraction occurring concomitantly with reduction during sintering, which is causative of cracking, peeling, and the like, is further less likely to occur. From such a viewpoint, the copper particles do not have to include copper oxide. The copper oxide may be cuprous oxide or cupric oxide. The copper oxide may be included in the copper particles as the copper oxide that is included in a natural oxide film produced on the surface of copper particles.

The copper particles may have a spherical shape, a clumpy shape, a needle-like shape, a flaky shape, a dendriform shape (dendritic shape), an approximately spherical shape, or the like, or may also have an irregular shape. Among these, when copper particles having a flaky shape, a dendriform shape, and an irregular shape are used, the porosity of the wick is easily improved. As the copper particles, two or more kinds of copper particles having shapes that are different from each other may be used. Preferred examples of a combination of copper particles having mutually different shapes include, for example, a combination of a spherical shape and a flaky shape, a combination of a spherical shape and a dendriform shape, and a combination of a spherical shape and an irregular shape. When copper particles having a spherical shape and copper particles having a flaky shape are used in combination, sinterability of the copper particles is improved, and a wick (sintered body) having excellent strength and excellent tight adhesiveness to an adherend tends to be easily formed. When copper particles having a spherical shape and copper particles having a dendriform shape are used in combination, and when copper particles having a spherical shape and copper particles having an irregular shape are used in combination, similar effects tend to be obtained.

The volume average particle diameter of the copper particles may be smaller than the film thickness of the wick to be formed. For example, when a thin-film wick having a thickness of about 50 μm is formed, the volume average particle diameter of the copper particles may be 45 μm or less. When copper particles having such a volume average particle diameter are used, the proportion of copper particles having a size larger than the target film thickness of the wick becomes small, a more satisfactory printed shape is obtained, and the film thickness of the wick easily satisfies the target value. From such a viewpoint, the ratio of the volume average particle diameter of the copper particles with respect to the thickness of the wick to be formed (volume average particle diameter of the copper particles/thickness of the wick) may be 0.9 or less, 0.8 or less, or 0.7 or less. The ratio of the volume average particle diameter of the copper particles with respect to the thickness of the wick to be formed (volume average particle diameter of the copper particles/thickness of the wick) may be 0.1 or more. Here, regarding the volume average particle diameter of the copper particles, when a particle size distribution of the copper particles on a volume basis is determined using a light scattering method particle size distribution analyzer, and a cumulative curve is determined by taking the total volume as 100%, the volume average particle diameter refers to the particle diameter (d50) at a point where the cumulative curve is 50%.

From the viewpoint of low-temperature sinterability, the 10% volume average particle diameter of the copper particles may be 5.0 μm or less, 4.0 μm or less, or 2.0 μm or less. The 10% volume average particle diameter of the copper particles may be 0.1 μm or more. That is, the 10% volume average particle diameter of the copper particles may be 0.1 to 5.0 μm, 0.1 to 4.0 μm, or 0.1 to 2.0 μm. Here, regarding the 10% volume average particle diameter of the copper particles, when a particle size distribution of the copper particles on a volume basis is determined using a light scattering method particle size distribution analyzer, and a cumulative curve is determined by taking the total volume as 100%, the 10% volume average particle diameter refers to the particle diameter at a point where the cumulative curve is 10%.

The proportion of the copper particles having a particle diameter larger than the film thickness of the wick to be formed (for example, coarse particles such as aggregates of primary particles) among the copper particles may be 10% by volume or less, 7% by volume or less, or 5% by volume or less, based on the total volume of the copper particles. When the proportion of copper particles having a particle diameter larger than the film thickness of the wick is in the above-described range, more excellent sinterability is likely to be obtained. From such a viewpoint, the copper paste does not have to include copper particles having a particle diameter larger than the film thickness of the wick. From the viewpoint of having more excellent sinterability, the proportion of copper particles having a particle diameter larger than 0.9 times the film thickness of the wick (for example, when the film thickness of the wick is 50 μm, a particle diameter larger than 45 μm) may also be in the above-described range. Here, the proportion of copper particles having a predetermined particle diameter can be determined by a particle sieving test, measurement of the copper paste by using a grind gauge, or the like. Incidentally, when copper particles and other components (thermally decomposable resin particles and the like) are present in mixture, for example, a liquid having a specific gravity of about 1.3 to 8.0 g/cm$^3$ is added thereto, the mixture is centrifuged, only copper particles are separated, and then the proportion of the copper particles can be determined by the above-described method.

The proportion of copper particles having a particle diameter of 1.5 μm or less among the copper particles may be 10% by volume or more, 12% by volume or more, or 15% by volume or more, based on the total volume of the copper particles, from the viewpoint of imparting sinterability. From the viewpoint of obtaining more excellent sinterability, among the copper particles, the proportion of copper particles having a particle diameter of 1.2 μm or less may also be in the above-described range, or the proportion of copper particles having a particle diameter of 1.0 μm or less may also be in the above-described range. The proportion of copper particles having a particle diameter of 1.5 μm or less may also be 80% by volume or less, 50% by volume or less, or 30% by volume or less, based on the total volume of the copper particles. The proportion of copper particles having a particle diameter of 1.5 μm or less may also be 100% by volume based on the total volume of the copper particles; however, from the viewpoint of making the pore size larger and from the viewpoint of making the porosity higher, copper particles having a particle diameter of more than 1.5 μm may be incorporated into the copper particles.

The proportion of copper particles having a particle diameter of 0.1 μm or less among the copper particles may be 5% by volume or less, 4% by volume or less, or 3% by volume or less, based on the total volume of the copper particles from the viewpoint of dispersibility, and may also be 0% by volume.

The copper paste including copper particles having a particle size distribution such as described above can be obtained by, for example, using two or more kinds of copper particles (particle groups) having different volume average particle diameters in combination as the copper particles. A combination of two or more kinds of copper particles may be, for example, a combination of copper particles having a volume average particle diameter of 5 to 50 μm (large-diameter copper particles) and copper particles having a volume average particle diameter of 0.1 to 2.0 μm (small-diameter copper particles). From the viewpoint of combustibility and from the viewpoint of miscibility, the large-diameter copper particles may have a flaky shape, a dendriform shape, or an irregular shape, and the small-diameter copper particles may have a spherical shape or an approximately spherical shape.

The amount of addition of the large-diameter copper particles may be 40% by mass or more, 60% by mass or more, 70% by mass or more, 75% by mass or more, or 80% by mass or more, based on the total mass of the copper particles, from the viewpoint of securing more preferable porosity and pore size. The amount of addition of the large-diameter copper particles may be 90% by mass or less, 87% by mass or less, 85% by mass or less, or 80% by mass or less, based on the total mass of the copper particles, from the viewpoint that a satisfactory balance with the amount of addition of the small-diameter copper particles is obtained. From the above-described viewpoints, the amount of addition of the large-diameter copper particles may be 40% to 90% by mass, 60% to 87% by mass, 70% to 85% by mass, 75% to 80% by mass, or 80% to 85% by mass, based on the total mass of the copper particles.

The amount of addition of the small-diameter copper particles may be 10% by mass or more, 15% by mass or more, or 20% by mass or more, based on the total mass of the copper particles, from the viewpoint that the sintered body has excellent adhesive strength and shape retention power. The amount of addition of the small-diameter copper particles may be 60% by mass or less, 30% by mass or less, 27% by mass or less, or 25% by mass or less, based on the total mass of the copper particles, from the viewpoint of improving the porosity and controlling the pore size. From the above-described viewpoints, the amount of addition of the small-diameter copper particles may be 10% to 60% by mass, 15% to 30% by mass, 20% to 27% by mass, or 20% to 25% by mass, based on the total mass of the copper particles.

The mass ratio of the content of the small-diameter copper particles to the amount of addition of the large-diameter copper particles (amount of addition of small-diameter copper particles/amount of addition of large-diameter copper particles) may be 0.1 or more, 0.18 or more, or 0.25 or more, from the viewpoint that the sintered body has excellent adhesive strength and shape retention power. The mass ratio (amount of addition of the small-diameter copper particles/amount of addition of the large-diameter copper particles) may be 1.0 or less, 0.6 or less, or 0.45 or less, from the viewpoint of improving the porosity and controlling the pore size. From the above-described viewpoints, the mass ratio may be 0.1 to 1.0, 0.18 to 0.6, or 0.25 to 0.45.

The content of the copper particles may be 70% by mass or more, 75% by mass or more, or 80% by mass or more, based on the total mass of the copper paste, from the viewpoint that viscosity adjustment is facilitated and from the viewpoint that more excellent printing properties are obtained. The content of the copper particles may be 90% by mass or less, 88% by mass or less, or 85% by mass or less, based on the total mass of the copper paste, from the viewpoint that viscosity adjustment is facilitated and from the viewpoint that more excellent printing properties are obtained. From these viewpoints, the content of the copper particles may be 70% to 90% by mass, 75% to 88% by mass, or 80% to 85% by mass, based on the total mass of the copper paste.

(Thermally Decomposable Resin Particles)

The thermally decomposable resin particles are resin particles composed of a thermally decomposable resin (thermally decomposable resin A). The content of the thermally decomposable resin A in the thermally decomposable resin particles may be 90% by mass or more, 93% by mass or more, or 95% by mass or more, based on the total mass of the thermally decomposable resin particles. The thermally decomposable resin particles may be formed only from the thermally decomposable resin A.

The thermally decomposable resin particles can be decomposed at a temperature lower than the sintering temperature. When the thermally decomposable resin particles have such thermal decomposition properties, pores are formed in the regions where the thermally decomposable resin particles were present during the sintering of the copper paste, and a wick having a high porosity is formed by sintering of the copper paste. Furthermore, since pores are formed in the regions where thermally decomposable resin particles were present, the porosity of the wick can be easily adjusted to desired ranges by adjusting the shape and content of the thermally decomposable resin particles, and the pore size can also be adjusted.

The 95% thermal decomposition temperature of the thermally decomposable resin particles may be 450° C. or lower, 400° C. or lower, or 350° C. or lower. When the 95% thermal decomposition temperature of the thermally decomposable resin particles is in the above-described range, the wick can be fired at a low temperature and for a short period of time, and residue of the thermally decomposable resin particles is less likely to be generated in the wick. From such a viewpoint, the 95% thermal decomposition temperature of the thermally decomposable resin A may also be in the above-described range. The 95% thermal decomposition temperature of the thermally decomposable resin particles may be 120° C. or higher. Incidentally, the 95% thermal decomposition temperature is defined as 95% weight loss temperature measured in the TG/DTA measurement. This temperature is a temperature measured in a reducing atmosphere including hydrogen, formic acid, and the like or in an inert gas atmosphere from which oxygen has been removed, rather than in an oxidizing atmosphere such as air.

The amount of residue (ash content) after thermal decomposition at the sintering temperature of the thermally decomposable resin particles may be 5% by mass or less or 2% by mass or less, with respect to the mass of the thermally decomposable resin particles before thermal decomposition. As the amount of residue after thermal decomposition is smaller, more satisfactory sinterability can be obtained. From such a viewpoint, the amount of residue (ash content) after thermal decomposition at the sintering temperature of the thermally decomposable resin A may also be in the above-described range. The ash content can be determined by TG/DTA measurement in a 3% to 5% by mass hydrogen-containing inert gas (nitrogen or argon). Specifically, a sample (thermally decomposable resin particles or thermally decomposable resin A) is retained at the sintering temperature only for the sintering time in a 3% to 5% by mass hydrogen-containing inert gas (nitrogen or argon), and the amount of weight change of the sample before and after retention is measured. The ash content can be determined from the obtained amount of weight change. Incidentally, in the TG/DTA measurement in air, oxidative decomposition of the sample proceeds, the amount of residue is small compared with the amount of residue in a reducing atmosphere, and therefore, TG/DTA measurement in air is not preferred.

The thermally decomposable resin particles can exist in a particulate form in the dispersion medium and is dispersed in the dispersion medium in the copper paste. The amount of dissolution of the thermally decomposable resin particles in 100 g of the dispersion medium at 25° C. is, for example, 1 g or less. From such a viewpoint, the amount of dissolution of the thermally decomposable resin A in 100 g of the dispersion medium at 25° C. may be 1 g or less.

The thermally decomposable resin A that constitutes the thermally decomposable resin particles may be a copolymer from the viewpoint of lowering the solubility of the resin particles in a solvent (dispersion medium) and may be a crosslinked body (thermally decomposable resin having a three-dimensionally crosslinked structure) from the viewpoint of further lowering the solubility. Examples of the thermally decomposable resin A include a (crosslinked) polycarbonate, (crosslinked) poly(meth)acrylic acid, a (crosslinked) poly(meth)acrylic acid ester, a (crosslinked) polyester, and a (crosslinked) polyether. The thermally decomposable resin A may be a crosslinked poly(meth) acrylic acid ester from the viewpoints of solvent resistance, cost, easy synthesis of particles, and thermal decomposition properties.

The thermally decomposable resin particles may have a spherical shape, a clumpy shape, an approximately spherical shape (for example, a long grain shape), a short fiber shape, or the like and may also be an irregular shape.

The volume average particle diameter of the thermally decomposable resin particles may be smaller than the film thickness of the wick to be formed, from the viewpoint that film thickness control is facilitated and from the viewpoint of not making the pore diameter excessively large. For example, the ratio of the volume average particle diameter of the thermally decomposable resin particles to the thickness of the wick (volume average particle diameter of the thermally decomposable resin particles/thickness of the wick) may be 0.9 or less, 0.8 or less, or 0.7 or less. Here, regarding the volume average particle diameter of the thermally decomposable resin particles, when a particle size distribution of the thermally decomposable resin particles on a volume basis is determined using a scattering method particle size distribution analyzer, and a cumulative curve is determined by taking the total volume as 100%, the volume average particle diameter refers to the particle diameter (d50) at the point where the cumulative curve is 50%.

The volume average particle diameter of the thermally decomposable resin particles may be 5 μm or more, 7 μm or more, or 9 μm or more, from the viewpoint that a wick having a large pore diameter is easily formed. The volume average particle diameter of the thermally decomposable resin particles may be 40 μm or less, 35 μm or less, or 30 μm or less, from the viewpoint of making the pore diameter excessively large. From such a viewpoint, the volume average particle diameter of the thermally decomposable resin particles may be 5 to 40 μm, 7 to 35 μm, or 9 to 30 μm.

The proportion of thermally decomposable resin particles having a particle diameter larger than the film thickness of the wick to be formed (for example, coarse particles such as aggregates of primary particles) among the thermally decomposable resin particles may be 10% by volume or less, 7% by volume or less, or 5% by volume or less, based on the total volume of the thermally decomposable resin particles, from the viewpoint that a more satisfactory printed shape is obtained and from the viewpoint that the film thickness of the wick easily satisfies the target value. From such a viewpoint, the copper paste does not have to include thermally decomposable resin particles having a particle diameter larger than the film thickness of the wick. From the viewpoint of not making the pore diameter excessively large, the proportion of thermally decomposable resin particles having a particle diameter larger than 0.9 times the film thickness of the wick (for example, when the film thickness of the wick is 50 μm, a particle diameter larger than 45 μm) may also be in the above-described range. Here, the proportion of thermally decomposable resin particles having a predetermined particle diameter can be determined by a particle sieving test, measurement of the copper paste by using a grind gauge, or the like.

The content of the thermally decomposable resin particles may be 3 parts by mass or more, 5 parts by mass or more, or 6 parts by mass or more, with respect to 100 parts by mass of the total amount of the copper particles and the thermally decomposable resin particles. In this case, a wick (sintered body) having a higher porosity is likely to be obtained. The content of the thermally decomposable resin particles may be 30 parts by mass or less, 25 parts by mass or less, 20 parts by mass or less, 15 parts by mass or less, or 10 parts by mass or less, with respect to 100 parts by mass of the total amount of the copper particles and the thermally decomposable resin particles. When the content of the thermally decomposable resin particles is 30 parts by mass or less, a wick (sintered body) having sufficient strength and tight adhesiveness is likely to be obtained, and when the content is 15 parts by mass or less, a wick (sintered body) having more excellent strength and tight adhesiveness is likely to be obtained, and when the content is 10 parts by mass or less, a wick (sintered body) having even more excellent strength and tight adhesiveness is likely to be obtained. From these viewpoints, the content of the thermally decomposable resin particles may be 3 to 30 parts by mass, 5 to 25 parts by mass, 6 to 20 parts by mass, 3 to 15 parts by mass, 5 to 15 parts by mass, 3 to 10 parts by mass, or 5 to 10 parts by mass, with respect to 100 parts by mass of the total amount of the copper particles and the thermally decomposable resin particles.

The content of the thermally decomposable resin particles may be 19 parts by volume or more, 29 parts by volume or more, or 33 parts by volume or more, with respect to 100 parts by volume of the total amount of the copper particles and the thermally decomposable resin particles. In this case, a wick (sintered body) having a higher porosity is likely to be obtained. The content of the thermally decomposable resin particles may be 77 parts by volume or less, 72 parts by volume or less, 66 parts by volume or less, 55 parts by volume or less, or 45 parts by volume or less, with respect to 100 parts by volume of the total amount of the copper particles and the thermally decomposable resin particles. When the content of the thermally decomposable resin particles is 77 parts by volume or less, a wick (sintered body) having sufficient strength and tight adhesiveness is likely to be obtained, when the content is 55 parts by mass or less, a wick (sintered body) having more excellent strength and tight adhesiveness is likely to be obtained, and when the content is 45 parts by mass or less, a wick (sintered body) having even more excellent strength and tight adhesiveness is likely to be obtained. From these viewpoints, the content of the thermally decomposable resin particles may be 19 to 77 parts by volume, 29 to 72 parts by volume, 33 to 66 parts by volume, 19 to 55 parts by volume, 29 to 55 parts by volume, 19 to 45 parts by volume, or 29 to 45 parts by volume, with respect to 100 parts by volume of the total amount of the copper particles and the thermally decomposable resin particles.

(Thermally Decomposable Resin B)

The thermally decomposable resin B is soluble in the dispersion medium. The amount of dissolution of the thermally decomposable resin B in 100 g of the dispersion medium at 25° C. is, for example, more than 5 g.

The thermally decomposable resin B is such that a portion or entirety thereof is dissolved in the dispersion medium in the copper paste. The amount of dissolution of the thermally decomposable resin B in the dispersion medium at 25° C. may be 5 parts by mass or more, 6 parts by mass or more, or 7 parts by mass or more, with respect to 100 parts by mass of the dispersion medium. The amount of the thermally decomposable resin B that is not dissolved in the dispersion medium may be 10% by mass or less, 5% by mass or less, or 3% by mass or less, of the total mass of the thermally decomposable resin B, from the viewpoint that the size of pores is easily controllable and from the viewpoint of suppressing adhesion to a printing mask.

The thermally decomposable resin B has thermal decomposition properties in addition to solubility in the above-described dispersion medium and can be dissolved at a temperature lower than the sintering temperature. Therefore, the thermally decomposable resin B functions as a binder for the copper particles and the thermally decomposable resin particles in the copper paste while being decomposed and forming pores between the particles during sintering.

The 95% thermal decomposition temperature of the thermally decomposable resin B may be 450° C. or lower, 400° C. or lower, or 350° C. or lower. When the 95% thermal decomposition temperature of the thermally decomposable resin is in the above-described range, the thermally decomposable resin B is easily removed at low temperature and firing at a low temperature of 500° C. or lower can be achieved, and residue of the thermally decomposable resin B is less likely to be generated in the wick. The 95% thermal decomposition temperature of the thermally decomposable resin may be 160° C. or higher from the viewpoint of removing only the dispersion medium in a drying process. The 95% thermal decomposition temperature can be measured in the same manner as in the case of the 95% thermal decomposition temperature of the thermally decomposable resin particles.

The amount of residue (ash content) after thermal decomposition of the thermally decomposable resin B at the sintering temperature may be 5% by mass or less or 2% by mass or less with respect to the mass of the thermally decomposable resin B before thermal decomposition. As the amount of residue after thermal decomposition is smaller, more satisfactory sinterability can be obtained. The ash content can be measured in the same manner as in the case of the ash content of the thermally decomposable resin particles.

Examples of the thermally decomposable resin B include a polycarbonate, poly(meth)acrylic acid, a poly(meth) acrylic acid ester, a polyester, and a polyether. The thermally decomposable resin B may be a polymethacrylic acid ester from the viewpoints of solubility in a dispersion medium (organic solvent), cost, and thermal decomposition properties.

The content of the thermally decomposable resin B may be 1 part by mass or more, 2 parts by mass or more, or 3 parts by mass or more, with respect to 100 parts by mass of the copper particles, from the viewpoint of having excellent shape retention power after printing and drying. The content of the thermally decomposable resin B may be 25 parts by mass or less, 20 parts by mass or less, 15 parts by mass or less, or 12 parts by mass or less, with respect to 100 parts by mass of the copper particles, from the viewpoint that viscosity adjustment is facilitated and from the viewpoint of having excellent sinterability. From these viewpoints, the content of the thermally decomposable resin B may be 1 to 25 parts by mass, 1 to 20 parts by mass, 2 to 15 parts by mass, or 3 to 12 parts by mass, with respect to 100 parts by mass of the copper particles.

(Dispersion Medium)

The dispersion medium is not particularly limited and may be, for example, a volatile dispersion medium. Examples of the volatile dispersion medium include monohydric and polyhydric alcohols such as pentanol, hexanol, heptanol, octanol, decanol, ethylene glycol, diethylene glycol, propylene glycol, butylene glycol, terpineol (α-terpineol, β-terpineol, γ-terpineol, and mixtures of these), dihydroterpineol, and isobornylcyclohexanol (MTPH); ethers such as ethylene glycol butyl ether, ethylene glycol phenyl ether, diethylene glycol methyl ether, diethylene glycol ethyl ether, diethylene glycol butyl ether, diethylene glycol isobutyl ether, diethylene glycol hexyl ether, triethylene glycol methyl ether, diethylene glycol dimethyl ether, diethylene glycol diethyl ether, diethylene glycol dibutyl ether, diethylene glycol butyl methyl ether, diethylene glycol isopropyl methyl ether, triethylene glycol dimethyl ether, triethylene glycol butyl methyl ether, propylene glycol propyl ether, dipropylene glycol methyl ether, dipropylene glycol ethyl ether, dipropylene glycol propyl ether, dipropylene glycol butyl ether, dipropylene glycol dimethyl ether, tripropylene glycol methyl ether, and tripropylene glycol dimethyl ether; esters such as ethylene glycol ethyl ether acetate, ethylene glycol butyl ether acetate, diethylene glycol ethyl ether acetate, diethylene glycol butyl ether acetate, dipropylene glycol methyl ether acetate (DPMA), ethyl lactate, butyl lactate, γ-butyrolactone, and propylene carbonate; acid amides such as N-methyl-2-pyrrolidone, N,N-dimethylacetamide, and N,N-dimethylformamide; aliphatic hydrocarbons such as cyclohexane, octane, nonane, decane, and undecane; aromatic hydrocarbons such as benzene, toluene, and xylene; mercaptans having an alkyl group having 1 to 18 carbon atoms; and mercaptans having a cycloalkyl group having 5 to 7 carbon atoms. Examples of the mercaptans having an alkyl group having 1 to 18 carbon atoms include ethylmercaptan, n-propylmercaptan, i-propylmercaptan, n-butylmercaptan, i-butylmercaptan, t-butylmercaptan, pentylmercaptan, hexylmercaptan, and dodecylmercaptan. Examples of the mercaptans having a cycloalkyl group having 5 to 7 carbon atoms include cyclopentylmercaptan, cyclohexylmercaptan, and cycloheptylmercaptan.

The content of the dispersion medium may be 5 parts by mass or more, may be 50 parts by mass or less, and may be 5 to 50 parts by mass, with respect to 100 parts by mass of the copper particles. When the content of the dispersion medium is in the above-described range, the copper paste can be adjusted to have more suitable viscosity, and sintering of the copper particles are not easily inhibited.

(Others)

The copper paste may further include other metal particles in addition to the copper particles. Examples of the other metal particles include particles of nickel, silver, gold, palladium, and platinum. The content of the other metal particles may be less than 20% by mass, may be 10% by mass or less, or may be 5% by mass or less, based on the total mass of the metal particles included in the copper paste. The copper paste does not have to include the other metal particles. Incidentally, when the copper paste includes other metal particles, in the present specification, a content with respect to 100 parts by mass of the copper particles may be read as a content with respect to 100 parts by mass of metal particles.

In the copper paste, dispersibility improvers such as an organic acid (for example, lauric acid) and an organic amine, wetting improvers such as a nonionic surfactant and a fluorine-based surfactant; an antifoaming agent such as silicone oil; an ion trapping agent such as an inorganic ion exchanger, and the like may be appropriately added as necessary.

The viscosity of the copper paste may be 10 to 120 Pa·s from the viewpoint of printability. Incidentally, the viscosity is a value measured by an E type viscometer under the conditions of a speed of rotation of 2.5 rpm at 25° C. As the E type viscometer, for example, product name: VISCOMETER-TV33 type viscometer manufactured by Toki Sangyo Co., Ltd. can be used. As a cone-rotor type measuring jig, for example, 3°×R14, SPP can be applied.

The thixotropic index (hereinafter, also referred to as "TI value") of the copper paste may be 2.0 or more and 20 or less, may be 3.0 or more and 15 or less, and may be 4.0 or more and 10 or less. When the TI value of the copper paste is in the above-described range, the viscosity of the copper paste is lowered by shear force, and therefore, printing is easily achieved by stirring manually or by means of a stirring device (for example, a rotation-revolution type stirring device (Planetary Vacuum Mixer ARV-310, manufactured by THINKY CORPORATION) or the like) before printing. Furthermore, after the copper paste is adhered to a member as an adherend, viscosity is restored by leaving the copper paste to stand still, and excessive wetting and spread of printed matter can be suppressed. Incidentally, the TI value is a value calculated by the following formula, when the viscosity measured using an E type viscometer under the conditions of a speed of rotation of 0.5 rpm at 25° C. is $\mu_{0.5}$, and the viscosity measured under the conditions of a speed of rotation of 5 rpm at 25° C. is $\mu_5$.

$$\text{TI value}=\mu_{0.5}/\mu_5$$

The above-mentioned copper paste can be prepared by mixing copper particles, thermally decomposable resin particles (particles containing the thermally decomposable resin A as a main component), thermally decomposable resin B, a dispersion medium, and other components. The copper paste can be prepared by, for example, dissolving the thermally decomposable resin B in a dispersion medium, subsequently adding the thermally decomposable resin particles and copper particles to the obtained solution, and subjecting the solution to a dispersion treatment. Furthermore, the copper paste may also be prepared by, for example, mixing the above-described solution obtainable by dissolving the thermally decomposable resin in a dispersion medium, with a dispersion liquid obtainable by mixing the thermally decomposable resin particles and copper particles with a dispersion medium and subjecting the mixture to a dispersion treatment. After mixing of each component, a stirring treatment may be carried out. The maximum diameter of the dispersion liquid may be adjusted by a classification operation.

The dispersion treatment can be carried out by using a dispersing machine or a stirrer. Examples include an Ishikawa type stirrer, a Silverson stirrer, a cavitation stirrer, a rotation-revolution type stirring device, an ultrathin film high-speed rotary dispersing machine, an ultrasonic dispersing machine, a grinding machine, a twin-screw kneader, a bead mill, a ball mill, a three-roll mill, a homomixer, a planetary mixer, an ultra-high pressure dispersing machine, and a thin layer shear dispersing machine.

The stirring treatment can be carried out using a stirrer. Examples include an Ishikawa type stirrer, a rotation-revolution type stirring device, a grinding machine, a twin-screw kneader, a three-roll mill, and a planetary mixer.

The classification operation can be carried out using, for example, filtration, natural sedimentation, and centrifugal separation. Examples of the filter for filtration include a water comb, a metal mesh, a metal filter, and a nylon mesh.

<Method for Forming Wick>

A method for forming a wick according to an embodiment includes a step of printing a copper paste and a step of sintering the copper paste. In this method, the copper paste of the above-described embodiment can be used. As the copper paste is sintered, a wick including a sintered body of the copper paste is obtained.

The method for printing the copper paste is not particularly limited. For example, screen printing, transfer printing, offset printing, jet printing method, a dispenser, a jet dispenser, a needle dispenser, a comma coater, a slit coater, a die coater, a gravure coater, slit coating, letterpress printing, intaglio printing, gravure printing, stencil printing, soft lithography, bar coating, an applicator, a particle deposition method, a spray coater, a spin coater, a dip coater, and electrodeposition coating can be used.

The method for sintering the copper paste is not particularly limited. The copper paste can be sintered by, for example, heat-treating (firing) the copper paste using a hot plate, a hot air dryer, a hot air heating furnace, a nitrogen dryer, an infrared dryer, an infrared heating furnace, a far-infrared heating furnace, a microwave heating device, a laser heating device, an electromagnetic heating device, a heater heating device, a steam heating furnace, or the like.

The gas atmosphere during the heating treatment may be an oxygen-free atmosphere from the viewpoint of suppressing oxidation of the obtained sintered body. The gas atmosphere during the heating treatment may also be a reducing atmosphere from the viewpoint of removing surface oxide of the copper particles in the copper paste. Examples of the oxygen-free atmosphere include an atmosphere of nitrogen, a noble gas, or the like, and a vacuum atmosphere. Examples of the reducing atmosphere include a pure hydrogen gas atmosphere, a mixed gas atmosphere of hydrogen and nitrogen as represented by foaming gas, a nitrogen atmosphere including formic acid gas, a mixed gas atmosphere of hydrogen and a noble gas, and a noble gas atmosphere including formic acid gas.

The highest temperature reached (firing temperature) during the heating treatment may be 150° C. or higher and 700° C. or lower, may be 200° C. or higher and 600° C. or lower, and 250° C. or higher and 550° C. or lower, from the viewpoint of reducing heat damage to each member and improving the product yield. When the highest temperature reached during the heating treatment is 150° C. or higher, sintering tends to sufficiently proceed when the retention time at the highest temperature reached during the heating treatment is 60 minutes or less.

The retention time at the highest temperature reached during the heating treatment may be 1 minute or more and 60 minutes or less, may be 1 minute or more and less than 40 minutes or less, or may be 1 minute or more and less than 30 minutes, from the viewpoint of volatilizing all the dispersion medium and from the viewpoint of improving the product yield.

The above-described method for forming a wick may further include a step of drying the copper paste before the step of sintering the copper paste. The gas atmosphere during drying may be air, may be an oxygen-free atmosphere of nitrogen, a noble gas, or the like, or may be a reducing atmosphere of hydrogen, formic acid, or the like. Regarding the drying method, drying may be performed by leaving the copper paste to stand at normal temperature, heated drying may be performed, or drying under reduced pressure may be performed. For the heated drying and drying under reduced pressure, for example, a hot plate, a hot air dryer, a hot air heating furnace, a nitrogen dryer, an infrared dryer, an infrared heating furnace, a far-infrared heating furnace, a microwave heating device, a laser heating device, an electromagnetic heating device, a heater heating device, a steam heating furnace, and a hot plate press device can be used. The conditions for drying (temperature and time) may be appropriately adjusted in accordance with the type and amount of the dispersion medium used. The conditions for drying (temperature and time) may be conditions of drying at 50° C. or higher and 180° C. or lower for 1 minute or more and 120 minutes or less.

According to the method for forming a wick described above, a wick having a high porosity can be formed by printing. Furthermore, in the above-described method, since a wick is formed by printing the copper paste, even when the surface on which the wick is formed has a complicated shape (for example, a shape with protrusions and depressions, a curved shape, or a shape having V-shaped depressions), a wick can be conveniently formed. Furthermore, in the above-described method, since the shape of the wick that can be formed has a high degree of freedom, a wick having a complicated shape (for example, a shape having a curve) can be easily formed. Furthermore, for example, a thin-film wick can also be formed by adjusting the particle diameter of the copper particles.

<Heat Pipe>

A heat pipe according to an embodiment includes a wick including a sintered body of the copper paste of the above-described embodiment. The configuration of the heat pipe excluding the wick can be a configuration similar to that of conventionally known heat pipes (vapor chamber or the like). The heat pipe can be produced by a method similar to that for conventionally known heat pipes, except for the step of forming a wick. A wick including a sintered body of the copper paste can be formed by the method for forming a wick according to the above-described embodiment. Hereinafter, an example of the heat pipe will be described with reference to the drawings.

FIG. 1 is a schematic cross-sectional view showing a heat pipe according to an embodiment. A heat pipe 1 includes a container 2 defining a sealed space S, a wick 3 accommodated in the space S of the container 2, and a working liquid. In the space S defined by the container 2, a gas phase space A is secured so that a volatilization product of the working liquid volatilized by a heat source can flow through. Although not shown in the diagram, the working liquid is, for example, water or an organic solvent and is impregnating the wick 3.

The shape of the container 2 is not particularly limited and may be a tubular shape, a flat plate shape, or the like. When the shape of the container 2 is a flat plate shape, for example, the copper paste is printed on depressions of a first base material having depressions formed on the surface to form a wick, and then the first base material and a second base material having depressions formed on the surface may be stuck together such that the depressions face each other. As a result, a heat pipe 1 including a flat plate-shaped container 2 is obtained.

The material of the container 2 is preferably a metal from the viewpoints of heat conductivity, pressure resistance, gas shielding properties, processability, and the like. As the metal, for example, copper, a copper alloy, aluminum, stainless steel, and carbon steel are used.

The wick 3 is disposed on the inner wall surface of the container 2. The wick 3 is a porous body formed by sintering the copper paste of the above-described embodiment and has pores. In other words, the wick 3 includes a sintered body of the copper paste of the above-described embodiment. The wick 3 may be integrally formed with the container 2 or may be formed in advance (disposed separately).

At least some of the pores of the wick 3 are formed in a region where the thermally decomposable resin particles and the thermally decomposable resin B were present. Usually, pores originating from the thermally decomposable resin particles are larger than the pores originating from the thermally decomposable resin B. The size of pores originating from the thermally decomposable resin particles is approximately the same as the particle diameter of the thermally decomposable resin particles, and the diameter of the pores is, for example, 5 to 40 μm, 7 to 35 μm, or 9 to 30 μm.

The porosity of the wick 3 (porosity of sintered body) may be 40% by volume or more, 45% by volume or more, or 50% by volume or more, based on the volume of the wick, from the viewpoint of the easiness of flow of the working liquid by a capillary phenomenon. The porosity of the wick 3 (porosity of sintered body) may be 80% by volume or less. The porosity is obtained by analyzing a cross-sectional image of a wick observed by scanning electron microscopy, scanning ion microscopy, or the like, by using image analysis software. Furthermore, when the composition of the metal material constituting the wick is known, the porosity may be determined from the difference between the volume of the wick and the volume of the metal in the wick. The volume of the metal is obtained, for example, by determining the apparent density $M_1$ (g/cm$^3$) from the volume of the wick and the mass of the wick measured with a precision balance, and determining the volume proportion from the following Formula (A) by using the determined $M_1$ and the density of the metal (for example, density of copper 8.96 g/cm$^3$).

$$\text{Volume proportion (\% by volume) of metal} = [(M_1)/(\text{density of metal})] \times 100 \quad \text{(A)}$$

The average pore diameter of the wick 3 may be 10 μm or more, 15 μm or more, or 20 μm or more, from the viewpoint that a satisfactory balance is obtained between flow resistance and capillary force. The average pore diameter of the wick 3 may be 50 μm or less, 45 μm or less, 40 μm or less, or 30 μm or less, from the viewpoint that a satisfactory balance is obtained between flow resistance and capillary force and from the viewpoint that thickness reduction of the wick is facilitated. The average pore diameter is determined by measuring the length of diameter of the pore portion on a SEM image of a cross-section that has been subjected to cast cross-sectional processing.

The thickness of the wick 3 may be 100 μm or less, 70 μm or less, 50 μm or less, or 40 μm or less. The thickness of the wick 3 may be 10 μm or more.

The heat pipe described above is used, for example, in a state in which a heat dissipation member is provided on the outer wall of the container. The heat pipe is suitably used as, for example, a heat dissipation device for small information equipment such as smartphones and tablets.

EXAMPLES

Hereinafter, the contents of the present invention will be described in more detail using Examples and Comparative Examples; however, the present invention is not intended to be limited to the following Examples.

Example 1

[Preparation of Copper Paste]

1.941 g of dihydroterpineol (manufactured by Nippon Terpene Chemicals, Inc.) as a dispersion medium, 16.964 g of KFA-2000 (methacrylic resin, manufactured by Goo Chemical Co., Ltd., 95% thermal decomposition temperature: 330° C., 33.6% by mass dihydroterpineol solution) as a thermally decomposable resin B, and 0.095 g of lauric acid as an additive (dispersibility improver) were introduced into a Polybottle, and the mixture was mixed with a rotation-revolution type stirring device (Planetary Vacuum Mixer ARV-310, manufactured by THINKY CORPORATION) to obtain a solution. To this solution, 15.066 g of CH-0200 (manufactured by MITSUI MINING & SMELTING CO., LTD., copper powder having a spherical shape, volume average particle diameter: 0.2 μm) and 60.264 g of 1400-YF (manufactured by MITSUI MINING & SMELTING CO., LTD., copper powder having a flaky shape, volume average particle diameter: 6.8 μm) as copper particles, and 5.670 g of GR-600T (acrylic resin particles, manufactured by Negami Chemical Industrial Co., Ltd., volume average particle diameter: 9.4 μm, 95% thermal decomposition temperature: 370° C.) as thermally decomposable resin particles were added, and the mixture was stirred at 2000 rpm for 1 minute using a rotation-revolution type stirring device (Planetary Vacuum Mixer ARV-310, manufactured by THINKY CORPORATION). Thereafter, the entirety was stirred once with a spatula to confirm that there was no solid matter, and the mixture was stirred at 2000 rpm for 2 minutes under reduced pressure to obtain a copper paste. The volume average particle diameter (d50) of the copper particles (mixed particles of CH-0200 and 1400-YF) in the copper paste was 5.5 μm, and the 10% volume average particle diameter was 2.9 μm. Furthermore, the content Cw of the thermally decomposable resin particles with respect to 100 parts by mass of the total amount of the copper particles and the thermally decomposable resin particles was 7 parts by mass, and the content Cv of the thermally decomposable resin particles with respect to 100 parts by volume of the total amount of the copper particles and the thermally decomposable resin particles was 36.4 parts by volume. Furthermore, the content of copper particles having a particle diameter of 1.5 μm or less (small diameter copper particles) was 20% by volume based on the total amount of the copper particles in the copper paste. Furthermore, the viscosity at 25° C. of the copper paste was 10 to 120 Pa·s.

[Production of Wick (1)]

A Hullcell copper plate was divided into three equal parts, and a copper plate having a size of 30 mm in length×67 mm in width×300 μm in thickness was prepared. On this copper plate, a SUS mask having a thickness of 70 μm provided with two openings each having a size of 25 mm×5 mm was placed, and the copper paste was printed using a metal squeegee.

The copper plate having the copper paste printed thereon, which was obtained by the above printing of the copper paste, was placed on a hot plate heated to 90° C. and dried in air for 20 minutes to obtain a firing sample. The sample was placed on a glass tray of a tubular-shaped furnace (manufactured by AVC Co., LTD.) and set in the tubular-shaped furnace. After pressure was reduced, 100 sccm of hydrogen and 900 sccm of nitrogen were caused to flow, and when the pressure returned to normal pressure, the sample was fired under the conditions of a firing temperature of 600° C., a heating time of 20 minutes, and a retention time of 60 minutes. Thereafter, the gases were stopped, forced air cooling was performed while pressure was reduced, and cooling was performed for 30 minutes. The pressure was returned to normal pressure with argon gas, and then the sample after firing was taken out into air. As a result, a sintered body (sintered body 1) of the copper paste having the thickness indicated in Table 1 was obtained. A heat pipe was constructed using the obtained sintered body 1, and it was confirmed that the sintered body 1 functioned as a wick.

[Production of Wick (2)]

Printing and firing of the copper paste were performed in the same manner as in Production of wick (1), except that an SUS mask having a thickness of 40 μm provided with two openings each having a size of 25 mm×5 mm was used as the SUS mask, and a sintered body (sintered body 2) of the copper paste having the thickness indicated in Table 1 was obtained. A heat pipe was constructed using the obtained sintered body 2, and it was confirmed that the sintered body 2 functioned as a wick.

[Production of Wick (3)]

Printing and firing of the copper paste were performed in the same manner as in Production of wick (1), except that an SUS mask having a thickness of 500 μm provided with two openings each having a size of 25 mm×5 mm was used as the SUS mask, and a sintered body (sintered body 3) of the copper paste having the thickness indicated in Table 1 was obtained. A heat pipe was constructed using the obtained sintered body 3, and it was confirmed that the sintered body 3 functioned as a wick.

Example 2

A copper paste was obtained in the same manner as in Example 1, except that GR-300T (acrylic resin particles, manufactured by Negami Chemical Industrial Co., Ltd., volume average particle diameter: 22 μm) was used instead of GR-600T as the thermally decomposable resin particles. The viscosity at 25° C. of the copper paste was 10 to 120 Pa·s. Next, Production of wick (1) to (3) were carried out in the same manner as in Example 1, except that the obtained copper paste was used, and sintered bodies (sintered bodies 1 to 3) of the copper paste having the thicknesses indicated in Table 1 were obtained. Heat pipes were constructed using the obtained sintered bodies 1 to 3, and it was confirmed that the sintered bodies 1 to 3 functioned as wicks.

Comparative Example 1

A copper paste was obtained in the same manner as in Example 1, except that thermally decomposable resin particles were not used, and that the blending amount of each component was changed to the amount indicated in Table 1. Next, Production of wick (1) to (3) were carried out in the same manner as in Example 1, except that the obtained copper paste was used, and sintered bodies (sintered bodies 1 to 3) of the copper paste having the thicknesses indicated in Table 1 were obtained.

TABLE 1

| | | | Example 1 | Example 2 | Comparative Example 1 |
|---|---|---|---|---|---|
| Blend (g) | Copper particles | CH-0200 | 15.066 | 15.066 | 16.200 |
| | | 1400YF | 60.264 | 60.264 | 64.800 |
| | Thermally decomposable resin particles | GR-600T | 5.670 | — | — |
| | | GR-300T | — | 5.670 | — |
| | Thermally decomposable resin | KFA-2000 | 16.964 | 16.964 | 16.964 |
| | Additive | Lauric acid | 0.095 | 0.095 | 0.095 |
| | Dispersion medium | Dihydro-terpineol | 1.941 | 1.941 | 1.941 |
| Content Cw of thermally decomposable resin particles (parts by mass) | | | 7 | 7 | — |
| Content Cv of thermally decomposable resin particles (parts by volume) | | | 36.4 | 36.4 | — |
| Content of small diameter copper particles (% by volume) | | | 20 | 20 | 20 |
| Film thickness of sintered body 1 (μm) | | | 40 | 40 | 35 |
| Film thickness of sintered body 2 (μm) | | | 20 | 20 | 25 |
| Film thickness of sintered body 3 (μm) | | | 320 | 300 | 308 |

<Evaluation 1-1>

For the sintered bodies 2 of Examples 1 and 2 and Comparative Example 1, a tape peeling test and the measurement of porosity were carried out. Specific evaluation methods will be described below, and the evaluation results are shown in Table 2.

[Tape Peeling Test]

CELLOTAPE (registered trademark) having a width of 16 mm manufactured by Nichiban Co., Ltd. was stuck onto the sintered body 2, and the tape was firmly rubbed with a fingertip for about 10 seconds. Thereafter, within 30 seconds or more and 5 minutes or less, an end of the tape was grasped at an angle as close to 60° as possible the tape was peeled off for 0.5 to 1.0 second, and the presence of adhered matter to the tape was checked. A case where there was no adhered matter was rated as A, a case where there was a small amount of adhered matter was partially present was rated as B, and a case where there was adhered matter over the entire surface was rated as C.

[Measurement of Porosity]

The sample obtained in Production of wick (2) (laminated body of a copper plate and the sintered body 2) was introduced into a plastic cup, a casting resin (EPOMOUNT, manufactured by Refine Tec, Ltd.) was poured therein, the casting resin was left to stand in a vacuum desiccator, and pressure was reduced to degas the casting resin. Thereafter, the casting resin was left to stand for 10 hours at room temperature to be cured. Using Refine Saw Excel (manufactured by Refine Tec, Ltd.) to which a resinoid grindstone was attached, the cast sample was cut near a cross-section that was wished to be observed. The cross-section was scraped with a polishing device (Refine Polisher Hv, manufactured by Refine Tec, Ltd.) to which water-resistant abrasive paper (Carbomac Paper, manufactured by Refine Tec, Ltd.) was attached, and was subjected to buff polishing using an alumina polishing liquid. This sample was observed using a SEM apparatus (TM-1000, manufactured by Hitachi High-Tech Corporation) at an applied voltage of 15 kV and a magnification of 500 times. A SEM observation image at a magnification of 500 times was binarized by Image J, which is image analysis software, and the porosity (unit: % by volume) of the sintered body (wick) was determined from the dot number ratio of white parts and black parts. Incidentally, in the present evaluation, three images were observed at different sites, the porosity in each image was determined, and the average value of these was taken as the porosity of the sintered body (wick).

TABLE 2

| | Example 1 | Example 2 | Comparative Example 1 |
|---|---|---|---|
| Tape peeling test | A | A | A |
| Porosity (vol %) | 58 | 60 | 34 |

As shown in Table 2, the sintered bodies of Examples 1 and 2 and Comparative Example 1 were all rated as A in the tape peeling test, and it was verified that the sintered bodies had satisfactory strength and tight adhesiveness to the adherend. Furthermore, it was verified that the porosity of the sintered body of Comparative Example 1 that did not use thermally decomposable resin particles was low, while the sintered bodies of Examples 1 and 2 had high porosities.

<Evaluation 1-2>

Figure 2:
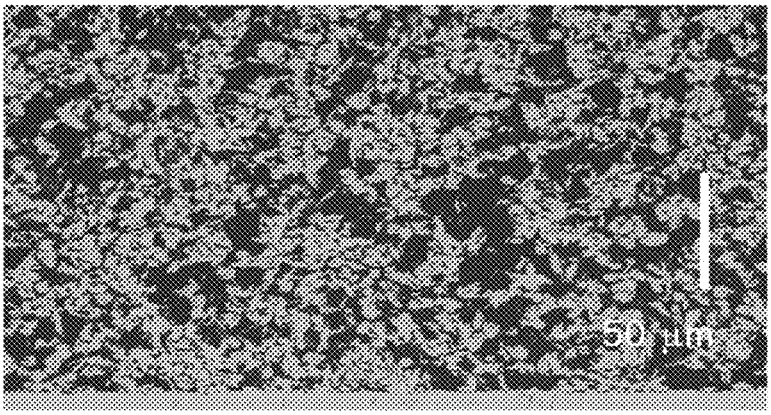
FIG. 2 is a diagram showing cross-sectional SEM images of sintered bodies (wicks) of Examples and Comparative Examples.
Figure 2:
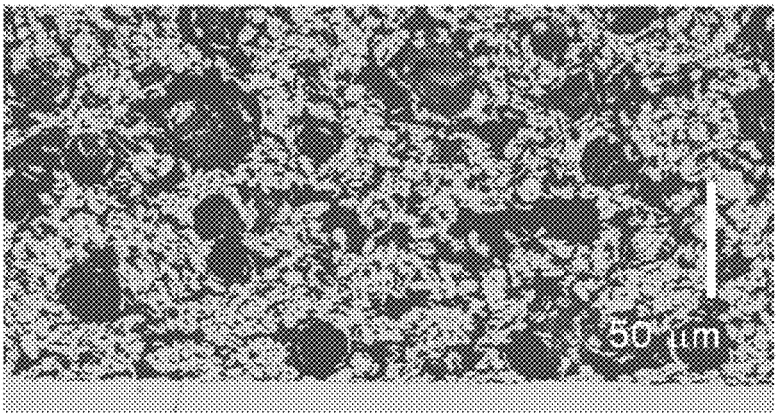
Figure 2:
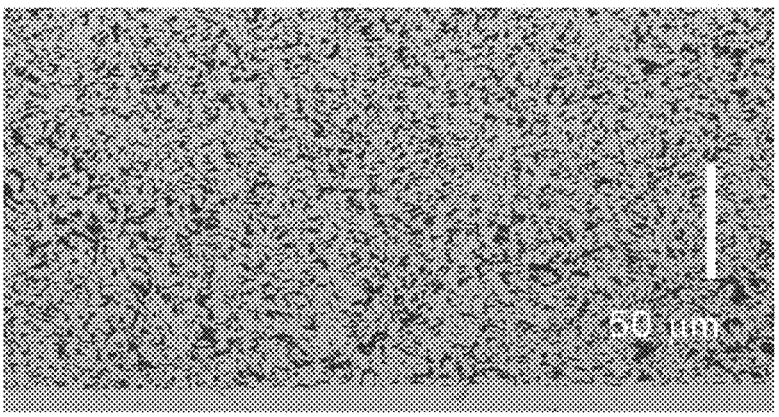

Cross-sectional SEM images of the sintered bodies 3 of Examples 1 and 2 and Comparative Example 1 were observed in the same manner as in the measurement of porosity. The observed cross-sectional SEM images are shown in FIG. 2. FIG. 2(*a*) is a cross-sectional SEM image of the sintered body 3 of Example 1, FIG. 2(*b*) is a cross-sectional SEM image of the sintered body 3 of Example 2, and FIG. 2(*c*) is a cross-sectional SEM image of the sintered body 3 of Comparative Example 1.

As shown in FIG. 2(*a*) and FIG. 2(*b*), in Examples 1 and 2 that used thermally decomposable resin particles, it could be confirmed that pores originating from the thermally decomposable resin particles (pores having approximately the same shape as the shape of the thermally decomposable resin particles and a size equivalent to the size of the thermally decomposable resin particles) were formed in addition to the pores inherent to the sintered body. On the other hand, as shown in FIG. 2(*c*), the pores of the sintered body of Comparative Example 1 that did not use thermally decomposable resin particles were only the pores inherent to the sintered body formed between copper particles, and the pore size was as small as several micrometers (μm).

Example 3

[Preparation of Copper Paste]

17.575 g of Terpineol C (manufactured by Nippon Terpene Chemicals, Inc.) as a dispersion medium, 1.330 g of M-6003 (methacrylic resin, manufactured by Negami Chemical Industrial Co., Ltd., 95% thermal decomposition temperature: 284° C.) as a thermally decomposable resin B, and 0.095 g of lauric acid as an additive (dispersibility improver) were introduced into a Polybottle, and the mixture was mixed with a rotation-revolution type stirring device (Planetary Vacuum Mixer ARV-310, manufactured by THINKY CORPORATION) and left to stand overnight to obtain a solution. To this solution, 15.39 g of CT-0500 (manufactured by MITSUI MINING & SMELTING CO., LTD., copper powder having a spherical shape, volume average particle diameter: 1 μm) and 60.75 g of FCC-115 (manufactured by FUKUDA METAL FOIL & POWDER CO., LTD., copper powder having a dendriform shape, volume average particle diameter: 30 μm) as copper particles, and 4.860 g of GR-300T (acrylic resin particles, manufactured by Negami Chemical Industrial Co., Ltd., volume average particle diameter: 22 μm, 95% thermal decomposition temperature: 350° C.) as thermally decomposable resin particles were added, and the mixture was stirred at 2000 rpm for 1 minute using a rotation-revolution type stirring device (Planetary Vacuum Mixer ARV-310, manufactured by THINKY CORPORATION). Thereafter, the entirety was stirred once with a spatula to confirm that there was no solid matter, and the mixture was stirred at 2000 rpm for 2 minutes under reduced pressure to obtain a copper paste. The content Cw of the thermally decomposable resin particles with respect to 100 parts by mass of the total amount of the copper particles and the thermally decomposable resin particles was 6 parts by mass, and the content Cv of the thermally decomposable resin particles with respect to 100 parts by volume of the total amount of the copper particles and the thermally decomposable resin particles was 32.6 parts by volume. Furthermore, the content of copper particles having a particle diameter of 1.5 μm or less (small diameter copper particles) was 20% by volume based on the total amount of the copper particles in the copper paste. Furthermore, the viscosity at 25° C. of the copper paste was 10 to 120 Pa·s.

[Production of Wick]

Production of wick (1) and (2) were carried out in the same manner as in Example 1, except that the copper paste obtained as described above was used, and that the firing temperature was changed to 450° C., and sintered bodies (sintered bodies 1 and 2) of the copper paste having the thicknesses indicated in Table 3 were obtained. Heat pipes were constructed using the obtained sintered bodies 1 and 2, and it was confirmed that the sintered bodies 1 and 2 functioned as wicks.

Examples 4 and 5

Each copper paste was produced in the same manner as in Example 3, except that the blending amount of each component was changed to the amount indicated in Table 3 such that the content Cw of the thermally decomposable resin particles with respect to 100 parts by mass of the total amount of the copper particles and the thermally decomposable resin particles would be 12 parts by mass or 20 parts by mass. The viscosity at 25° C. of the copper paste was 10 to 120 Pa·s. Next, Production of wick (1) and (2) were carried out in the same manner as in Example 3, except that the obtained copper pastes were used, and sintered bodies (sintered bodies 1 and 2) of the copper pastes having the thicknesses indicated in Table 3 were obtained. Heat pipes were constructed using the obtained sintered bodies 1 and 2, and it was confirmed that the sintered bodies 1 and 2 functioned as wicks.

Comparative Example 2

A copper paste was produced in the same manner as in Example 3, except that thermally decomposable resin particles were not used, and that the blending amount of each component was changed to the amount indicated in Table 3. Next, Production of wick (1) and (2) were carried out in the same manner as in Example 1, except that the obtained copper paste was used, and sintered bodies (sintered bodies 1 and 2) of the copper paste having the thicknesses indicated in Table 1 were obtained.

TABLE 3

| | | | Example 3 | Example 4 | Example 5 | Comparative Example 2 |
|---|---|---|---|---|---|---|
| Blend (g) | Copper particles | CT-0500 | 15.390 | 14.256 | 12.960 | 16.200 |
| | | FCC-115 | 60.750 | 57.024 | 51.840 | 64.800 |
| | Thermally decomposable resin particles | GR-300T | 4.860 | 9.720 | 16.200 | — |
| | Thermally decomposable resin | M-6003 | 1.330 | 1.330 | 1.330 | 1.330 |
| | Additive | Lauric acid | 0.095 | 0.095 | 0.095 | 0.095 |
| | Dispersion medium | Terpineol C | 17.575 | 17.575 | 17.575 | 17.575 |
| Content Cw of thermally decomposable resin particles (parts by mass) | | | 6 | 12 | 20 | — |
| Content Cv of thermally decomposable resin particles (parts by volume) | | | 32.6 | 50.9 | 65.5 | — |
| Content of small diameter copper particles (% by volume) | | | 20 | 20 | 20 | 20 |
| Film thickness of sintered body 1 (μm) | | | 30 | 30 | 27 | 40 |
| Film thickness of sintered body 2 (μm) | | | 20 | 20 | 15 | 20 |

<Evaluation 2-1>

For the sintered bodies 2 of Examples 3 to 5 and Comparative Example 2, a tape peeling test and the measurement of porosity were carried out in the same manner as in Evaluation 1-1. The evaluation results are shown in Table 4.

TABLE 4

| | Example 3 | Example 4 | Example 5 | Comparative Example 2 |
|---|---|---|---|---|
| Tape peeling test | A | B | C | A |
| Porosity (vol %) | 60 | 65 | 79 | 50 |

As shown in Table 4, the sintered body of Example 3 was rated as A in the tape peeling test, and it was confirmed that the sintered body had satisfactory strength and tight adhesiveness to the adherend. Furthermore, it was confirmed that the porosity of the sintered body of Comparative Example 2 that did not use thermally decomposable resin particles was low, while the sintered bodies of Examples 3 to 5 had high porosities.

<Evaluation 2-2>

Figure 3:
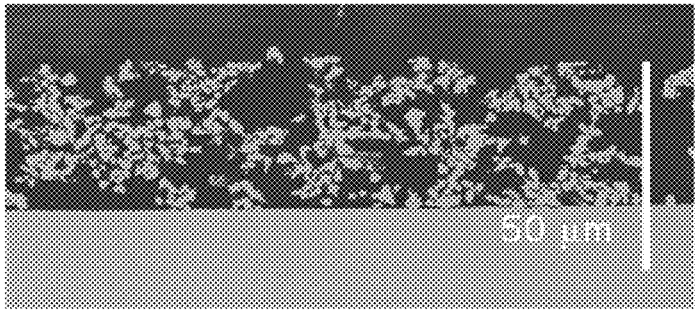
FIG. 3 is a diagram showing cross-sectional SEM images of sintered bodies (wicks) of Examples.
Figure 3:
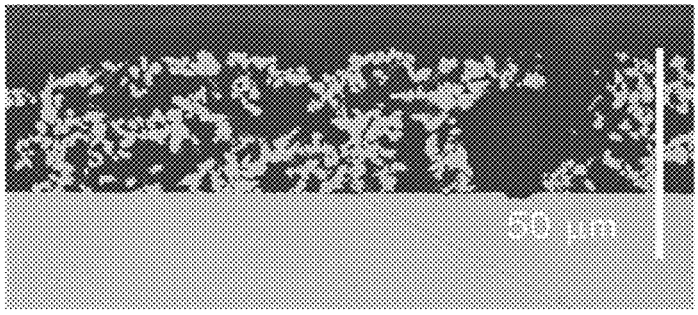
Figure 3:
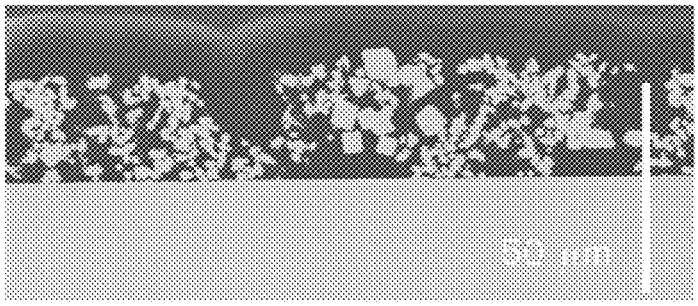

Cross-sectional SEM images of the sintered bodies 1 of Examples 3 to 5 were observed in the same manner as in Evaluation 1-2. The observed cross-sectional SEM images are shown in FIG. 3. FIG. 3(*a*) is a cross-sectional SEM image of the sintered body 1 of Example 3, FIG. 3(*b*) is a cross-sectional SEM image of the sintered body 1 of Example 4, and FIG. 3(*c*) is a cross-sectional SEM image of the sintered body 1 of Example 5.

As shown in FIG. 3(*a*) to FIG. 3(*c*), in Examples 3 to 5 that used thermally decomposable resin particles, it could be confirmed that pores originating from the thermally decomposable resin particles (pores having approximately the same shape as the shape of the thermally decomposable resin particles and a size equivalent to the size of the thermally decomposable resin particles) were formed in addition to the pores inherent to the sintered body.

Examples 6 and 7

Each copper paste was produced in the same manner as in Example 4, except that EBY (manufactured by MITSUI MINING & SMELTING CO., LTD., copper powder having a dendriform shape, volume average particle diameter: 6.7 μm) or EAX small diameter product (manufactured by MITSUI MINING & SMELTING CO., LTD., copper powder having a dendriform shape, volume average particle diameter: 13.2 μm) was used instead of FCC-115. The content of copper particles having a particle diameter of 1.5 μm or less (small diameter copper particles) was 20% by volume based on the total amount of the copper particles in the copper paste. Furthermore, the viscosity at 25° C. of the copper paste was 10 to 120 Pa·s.

Next, Production of wick (1) and (2) were carried out in the same manner as in Example 4, except that the obtained copper pastes were used, and sintered bodies (sintered bodies 1 and 2) of the copper pastes having the thicknesses indicated in Table 5 were obtained. Heat pipes were constructed using the obtained sintered bodies 1 and 2, and it was confirmed that the sintered bodies 1 and 2 functioned as wicks.

TABLE 5

| | | | Example 6 | Example 7 |
|---|---|---|---|---|
| Blend (g) | Copper particles | CT-0500 | 14.256 | 14.256 |
| | | EBY | 57.024 | — |
| | | EAX (small diameter product) | — | 57.024 |
| | Thermally decomposable resin particles | GR-300T | 9.720 | 9.720 |
| | Thermally decomposable resin | M-6003 | 1.330 | 1.330 |
| | Additive | Lauric acid | 0.095 | 0.095 |
| | Dispersion medium | Terpineol C | 17.575 | 17.575 |
| Content Cw of thermally decomposable resin particles (parts by mass) | | | 12 | 12 |
| Content Cv of thermally decomposable resin particles (parts by volume) | | | 50.9 | 50.9 |
| Content of small diameter copper particles (% by volume) | | | 20 | 20 |
| Film thickness of sintered body 1 (μm) | | | 45 | 30 |
| Film thickness of sintered body 2 (μm) | | | 15 | 15 |

<Evaluation 3-1>

For the sintered bodies 2 of Examples 6 and 7, a tape peeling test and the measurement of porosity were carried out in the same manner as in Evaluation 1-1. The evaluation results are shown in Table 6.

TABLE 6

| | Example 6 | Example 7 |
|---|---|---|
| Tape peeling test | A | A |
| Porosity (vol %) | 59 | 67 |

As shown in Table 6, the sintered bodies of Example 6 and 7 were all rated as A in the tape peeling test, and it was confirmed that the sintered bodies had satisfactory strength and tight adhesiveness to the adherend. Furthermore, it was confirmed that the sintered bodies of Examples 6 and 7 had high porosities.

<Evaluation 3-2>

Figure 4:
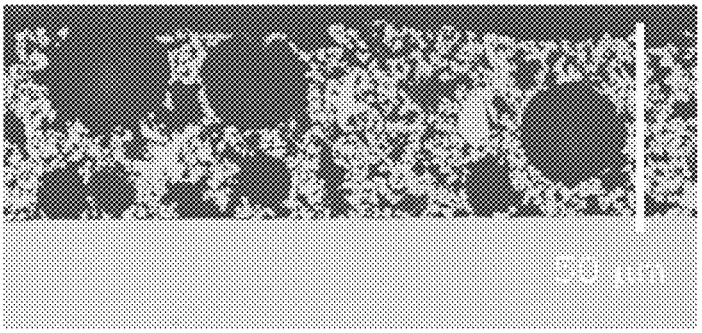
FIG. 4 is a diagram showing cross-sectional SEM images of sintered bodies (wicks) of Examples.
Figure 4:
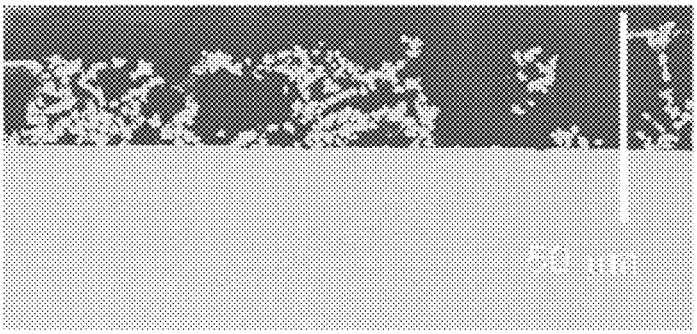

Cross-sectional SEM images of the sintered bodies 1 of Examples 6 and 7 were observed in the same manner as in Evaluation 1-2. The observed cross-sectional SEM images are shown in FIG. 4. FIG. 4(*a*) is a cross-sectional SEM image of the sintered body 1 of Example 6, and FIG. 4(*b*) is a cross-sectional SEM image of the sintered body 1 of Example 7.

As shown in FIG. 4(*a*) and FIG. 4(*b*), in Examples 6 and 7 that used thermally decomposable resin particles, it could be confirmed that pores originating from the thermally decomposable resin particles (pores having approximately the same shape as the shape of the thermally decomposable resin particles and a size equivalent to the size of the thermally decomposable resin particles) were formed in addition to the pores inherent to the sintered body.

Example 8

A copper paste was produced in the same manner as in Example 4, except that EAX large diameter product (manufactured by MITSUI MINING & SMELTING CO., LTD., copper powder having a dendriform shape, volume average particle diameter: 16.5 μm) was used instead of FCC-115. The content of copper particles having a particle diameter of 1.5 μm or less (small diameter copper particles) was 20% by volume based on the total amount of the copper particles in the copper paste. Furthermore, the viscosity at 25° C. of the copper paste was 10 to 120 Pa·s.

Next, Production of wick (1) was carried out in the same manner as in Example 4, except that the obtained copper paste was used, and a sintered body (sintered body 1) of the copper paste having the thickness indicated in Table 7 was obtained. A heat pipe was constructed using the obtained sintered body 1, and it was confirmed that the sintered body 1 functioned as a wick.

Example 9

A copper paste of Example 9 was produced in the same manner as in Example 4, except that CH-0200 was used instead of CT-0500, and that CuAtW-250 (manufactured by FUKUDA METAL FOIL & POWDER CO., LTD., copper powder having an irregular shape, volume average particle diameter: 30 μm) was used instead of FCC-115. The content of copper particles having a particle diameter of 1.5 μm or less (small diameter copper particles) was 20% by volume based on the total amount of the copper particles in the copper paste. Furthermore, the viscosity at 25° C. of the copper paste was 10 to 120 Pa·s.

Next, Production of wick (1) was carried out in the same manner as in Example 4, except that the obtained copper paste was used, and a sintered body (sintered body 1) of the copper paste having the thickness indicated in Table 7 was obtained. A heat pipe was constructed using the obtained sintered body 1, and it was confirmed that the sintered body 1 functioned as a wick.

Example 10

A copper paste was produced in the same manner as in Example 9, except that CT-0500 was used instead of CH-0200, and that the blending amount of each component was changed to the amount indicated in Table 7 such that the content Cw of the thermally decomposable resin particles with respect to 100 parts by mass of the total amount of the copper particles and the thermally decomposable resin particles would be 25 parts by mass. The content of copper particles having a particle diameter of 1.5 μm or less (small diameter copper particles) was 20% by volume based on the total amount of the copper particles in the copper paste. Furthermore, the viscosity at 25° C. of the copper paste was 10 to 120 Pa·s.

Next, Production of wick (1) was carried out in the same manner as in Example 9, except that the obtained copper paste was used, and a sintered body (sintered body 1) of the copper paste having the thickness indicated in Table 7 was obtained. A heat pipe was constructed using the obtained sintered body 1, and it was confirmed that the sintered body 1 functioned as a wick.

TABLE 7

| | | | Example 8 | Example 9 | Example 10 |
|---|---|---|---|---|---|
| Blend (g) | Copper particles | CT-0500 | 14.256 | — | 12.15 |
| | | CH-0200 | — | 14.256 | — |
| | | EAX (large diameter product) | 57.024 | — | — |
| | | CuAtW-250 | — | 57.024 | 48.6 |
| | Thermally decomposable resin particles | GR-300T | 9.720 | 9.720 | 20.250 |
| | Thermally decomposable resin | M-6003 | 1.330 | 1.330 | 2.660 |
| | Additive | Lauric acid | 0.095 | 0.095 | 0.095 |
| | Dispersion medium | Terpineol C | 17.575 | 17.575 | 16.245 |
| Content Cw of thermally decomposable resin particles (parts by mass) | | | 12 | 12 | 25 |
| Content Cv of thermally decomposable resin particles (parts by volume) | | | 50.9 | 50.9 | 71.7 |
| Content of small diameter copper particles (% by volume) | | | 20 | 20 | 20 |
| Film thickness of sintered body 1 (μm) | | | 70 | 60 | 55 |

<Evaluation 4-1>

The measurement of porosity was carried out in the same manner as in Evaluation 1-1 for the sintered bodies 1 of Examples 8 to 10. The evaluation results are shown in Table 8.

TABLE 8

| | Example 8 | Example 9 | Example 10 |
|---|---|---|---|
| Porosity (vol %) | 70 | 77 | 69 |

As shown in Table 8, it was confirmed that the sintered bodies of Examples 8 to 10 had high porosities.

<Evaluation 4-2>

Figure 5:
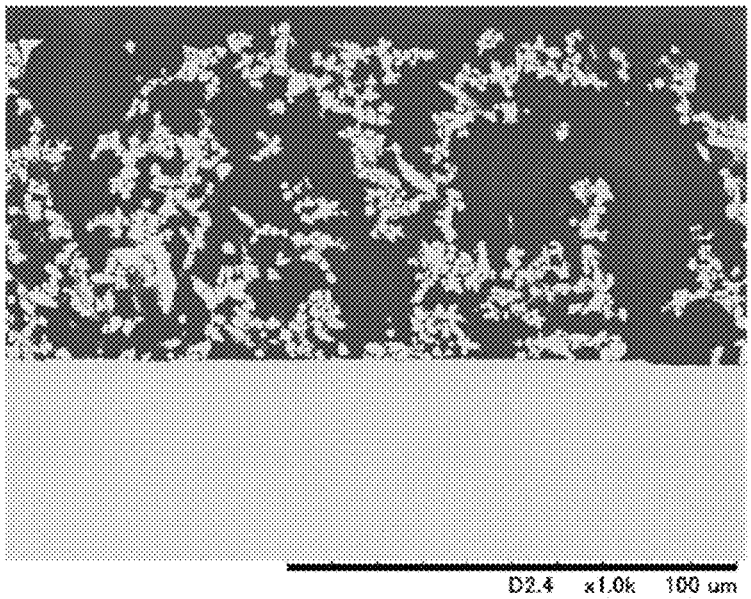
FIG. 5 is a diagram showing a cross-sectional SEM image of a sintered body (wick) of Examples.

A cross-sectional SEM image of the sintered body 1 of Example 8 was observed in the same manner as in Evaluation 1-2. The observed cross-sectional SEM image is shown in FIG. 5. As shown in FIG. 5, in Example 8 that used thermally decomposable resin particles, it could be confirmed that pores originating from the thermally decomposable resin particles (pores having approximately the same shape as the shape of the thermally decomposable resin particles and a size equivalent to the size of the thermally decomposable resin particles) were formed in addition to the pores inherent to the sintered body.

REFERENCE SIGNS LIST

1: heat pipe, 2: container, 3: wick.

The invention claimed is:

1. A copper paste for forming a wick of a heat pipe, the copper paste comprising:

copper particles;

thermally decomposable resin particles comprising a thermally decomposable resin A;

a dispersion medium for dispersing the copper particles and the thermally decomposable resin particles; and a thermally decomposable resin B that is soluble in the dispersion medium.

2. The copper paste according to claim 1, wherein a content of the thermally decomposable resin particles is 3 to 30 parts by mass with respect to 100 parts by mass of a total amount of the copper particles and the thermally decomposable resin particles.

3. The copper paste according to claim 1, wherein the thermally decomposable resin particles have a volume average particle diameter of 5 to 40 μm.

4. The copper paste according to claim 1, wherein a 95% thermal decomposition temperature of the thermally decomposable resin particles and the thermally decomposable resin B is 450° C. or lower.

5. The copper paste according to claim 1, wherein a content of the thermally decomposable resin B is 1 to 25 parts by mass with respect to 100 parts by mass of the copper particles.

6. The copper paste according to claim 1, wherein a proportion of copper particles having a particle diameter of 1.5 μm or less is 10% by volume or more based on a total amount of the copper particles.

7. The copper paste according to claim 1, wherein the copper paste has a viscosity at 25° C. of 10 to 120 Pa·s.

8. A method for forming a wick of a heat pipe, the method comprising:

a step of printing the copper paste according to claim 1; and a step of sintering the copper paste.

9. A heat pipe comprising a wick including a sintered body of the copper paste according to claim 1.

10. The copper paste according to claim 1, wherein an amount of dissolution of the thermally decomposable resin particles in 100 g of the dispersion medium at 25° C. is 1 g or less.

11. The copper paste according to claim 10, wherein an amount of dissolution of the thermally decomposable resin B in the dispersion medium at 25° C. is 5 parts by mass or more with respect to 100 parts by mass of the dispersion medium.

12. The copper paste according to claim 1, wherein an amount of dissolution of the thermally decomposable resin B in the dispersion medium at 25° C. is 5 parts by mass or more with respect to 100 parts by mass of the dispersion medium.

13. The copper paste according to claim 1, wherein thermally decomposable resin A is selected from the group consisting of a (crosslinked) polycarbonate, (crosslinked) poly(meth)acrylic acid, a (crosslinked) poly(meth)acrylic acid ester, a (crosslinked) polyester, and a (crosslinked) polyether.

14. The copper paste according to claim 13, wherein thermally decomposable resin B is selected from the group consisting of a polycarbonate, poly(meth)acrylic acid, a poly(meth)acrylic acid ester, a polyester, and a polyether.

15. The copper paste according to claim 1, wherein thermally decomposable resin B is selected from the group consisting of a polycarbonate, poly(meth)acrylic acid, a poly(meth)acrylic acid ester, a polyester, and a polyether.

16. A copper paste for forming a wick of a heat pipe, the copper paste comprising:

a dispersion medium;

copper particles dispersed in the dispersion medium;

thermally decomposable resin particles comprising a thermally decomposable resin A dispersed in the dispersion medium; and a thermally decomposable resin B, at least a portion of which is dissolved in the dispersion medium.

17. The copper paste according to claim 16, wherein an amount of dissolution of the thermally decomposable resin particles in 100 g of the dispersion medium at 25° C. is 1 g or less, and an amount of dissolution of the thermally decomposable resin B in the dispersion medium at 25° C. is 5 parts by mass or more with respect to 100 parts by mass of the dispersion medium.

18. The copper paste according to claim 16, wherein thermally decomposable resin A is selected from the group consisting of a (crosslinked) polycarbonate, (crosslinked) poly(meth)acrylic acid, a (crosslinked) poly(meth)acrylic acid ester, a (crosslinked) polyester, and a (crosslinked) polyether, and thermally decomposable resin B is selected from the group consisting of a polycarbonate, poly(meth) acrylic acid, a poly(meth)acrylic acid ester, a polyester, and a polyether.

19. The copper paste according to claim 16, wherein a content of the thermally decomposable resin particles is 3 to 30 parts by mass with respect to 100 parts by mass of a total amount of the copper particles and the thermally decomposable resin particles.

20. A heat pipe comprising a wick including a sintered body of the copper paste according to claim 16.

* * * * *